US005975628A

United States Patent [19]

Russell

[11] Patent Number: 5,975,628

[45] **Date of Patent: *Nov. 2, 1999**

[54] CHILDREN'S HIGH CHAIR TRAY

[75] Inventor: Larry L. Russell, Tiburon, Calif.

[73] Assignee: Reed International, Ltd., Berkeley, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/725,154

[22] Filed: Oct. 3, 1996

[51] Int. Cl.[6] ..... A47B 39/00

[52] U.S. Cl. ..... 297/135; 297/148

[58] Field of Search ..... 297/DIG. 6, 135, 297/148–155, 440.14, 440.13, 440.1, 440.12, 463.2, 217.1; 24/306; 108/26, 43

[56] References Cited

U.S. PATENT DOCUMENTS

| | | | |
|---|---|---|---|
| 2,684,110 | 7/1954 | Stone | 108/26 X |
| 3,635,522 | 1/1972 | Kerwit | 297/153 |
| 4,155,126 | 5/1979 | Classen | 297/153 X |
| 4,662,676 | 5/1987 | Havelock | 108/26 X |
| 4,908,066 | 3/1990 | Taylor et al. | 108/26 |
| 5,055,081 | 10/1991 | Nayak | 108/26 X |
| 5,558,391 | 9/1996 | Chavous | 297/153 |
| 5,586,800 | 12/1996 | Triplett | 297/153 X |

*Primary Examiner*—Milton Nelson, Jr.
*Attorney, Agent, or Firm*—Limbach & Limbach L.L.P.

[57] ABSTRACT

A tray for a child's high chair. A section of interlocking elements that engage a complementary surface on eating utensils or toys permits removably securing the eating utensil or toy to the tray surface. Tray dimensions may be customized to fit tables of commercially available children's high chairs. The tray may also include a smooth surface that accommodates eating utensils and toys that do not have interlocking elements.

4 Claims, 2 Drawing Sheets

CHILDREN'S HIGH CHAIR TRAY

BACKGROUND OF THE INVENTION

1. Field of the Invention

The present invention relates to a child's high chair tray that is used in combination with eating utensils having elements that interlock with the upper surface of the high chair tray. More particularly, the present invention relates to a child's high chair tray having a surface of a continuous section of elements that mate with complementarily shaped elements on the eating utensils and toys to secure the utensils and toys to the tray surface.

2. Description of the Related Art

Children's furniture capable of use with interlocking building blocks is known. For example, U.S. Pat. No. 5,218,912 relates to a child's laptop, portable play table having an upper surface that interlocks with building blocks and one or more storage compartments. U.S. Pat. No. 5,360,264 relates to a child's play table with a reversible table top, one side of which includes modular building block interconnecting surface and smooth reverse side for playing with toys, puzzles and games. U.S. Pat. No. 5,055,081 relates to a child's play table with a surface that interlocks with toy building blocks. The table surface extends around a centrally located opening that leads to a storage compartment. However, none of these patents disclose children's furniture designed specifically for eating or eating utensils with complementarily shaped interlocking elements that mate with table surface.

SUMMARY OF THE INVENTION

An apparatus according to the present invention addresses these and other problems of the prior art by providing a tray for a child's high chair. The tray surface has a continuous section of interlocking elements that engage with a complementary surface on eating utensils to permit removably securing eating utensils to the tray surface. The tray surface can also be used with toys made with interlocking blocks.

Tray dimensions may be adjusted for customizing trays to fit tables of commercially available children's high chair tables of various dimensions.

BRIEF DESCRIPTION OF THE DRAWINGS

The present invention will be further described in connection with the drawings of the following figures, wherein like reference numerals refer to like elements a in which.

DESCRIPTION OF THE PREFERRED EMBODIMENTS

Figure 1:
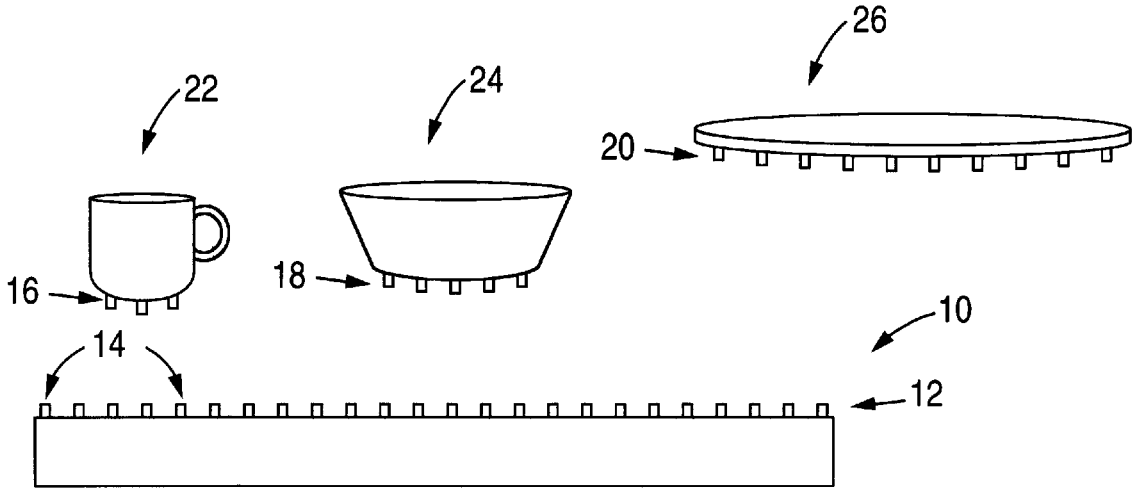
FIG. 1 is a side view of one embodiment of a child's high chair ay according to the present invention.
Figure 2:
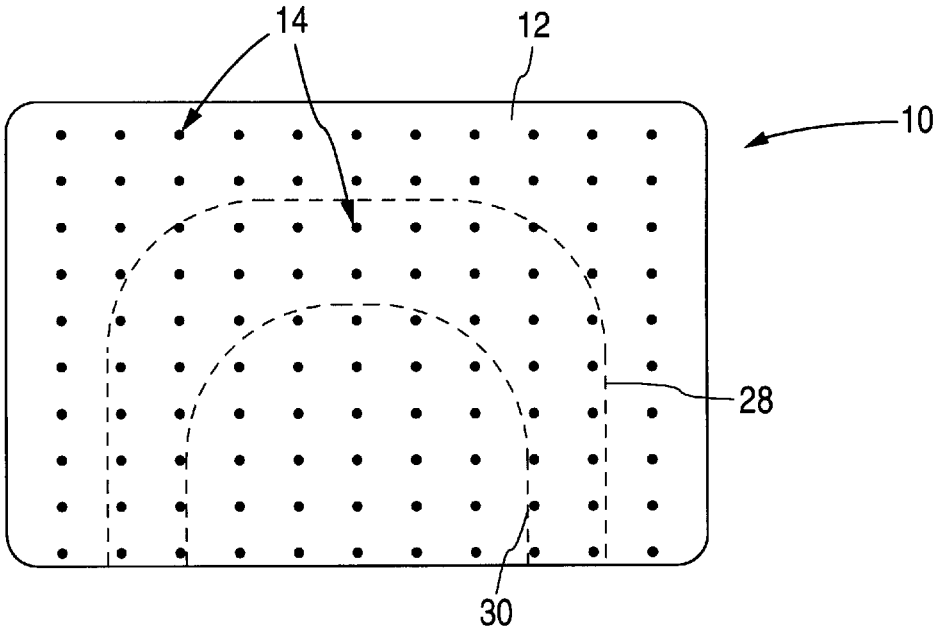
FIG. 2 is a plan view of one embodiment of a child's high chair ay according to the present invention.

FIGS. 1 through 4 illustrate a removable tray 10 for a child's high chair having a shape similar to those of well known design. Upper surface 12 of tray 10 according to the present invention is at least partly adapted to include interlocking building block elements of the type sold under the trademarks DUPLO, LEGO and MEGA BLOKS among others. Thus, surface 12 has numerous regularly spaced projections 14 that interlock with complementarily adapted surfaces 16, 18 and 20 on eating utensils such as cups 22, bowls 24 and plates 26, respectively. Toys built from interlocking building blocks may also be engaged on the upper surface 12. In this way, eating utensils (or toys) and the tray surface "snap" together securing the eating utensils to the tray surface sufficiently so that the child cannot knock the utensils over and spilling the contents. An adult can easily remove the utensils (or toys) by gently pulling the eating utensils (or toys) from the tray, for example for cleaning and sanitation.

Trays according to the present invention include those in which a surface of the high chair tray features interlocking elements or a tray with such a surface that is adapted to fit or be fastened to a conventional child's high chair table.

In the form of the invention which the tray will be arranged over a conventional, existing tray, it may be useful to make the tray in a form in which the size of the tray can be tailored to more closely fit the existing tray. In this regard, adjustment of the size of tray 10 can be achieved, e.g., by including perforations 28 and/or 30, so that the user can simply modify the tray size to fit the tray of the user's existing children's high chair. Fastening of this "retrofit" tray to a conventional high chair tray can be accomplished using clamps or complementary hook and adhesive pile (commercially available as VELCRO brand).

Figure 3:
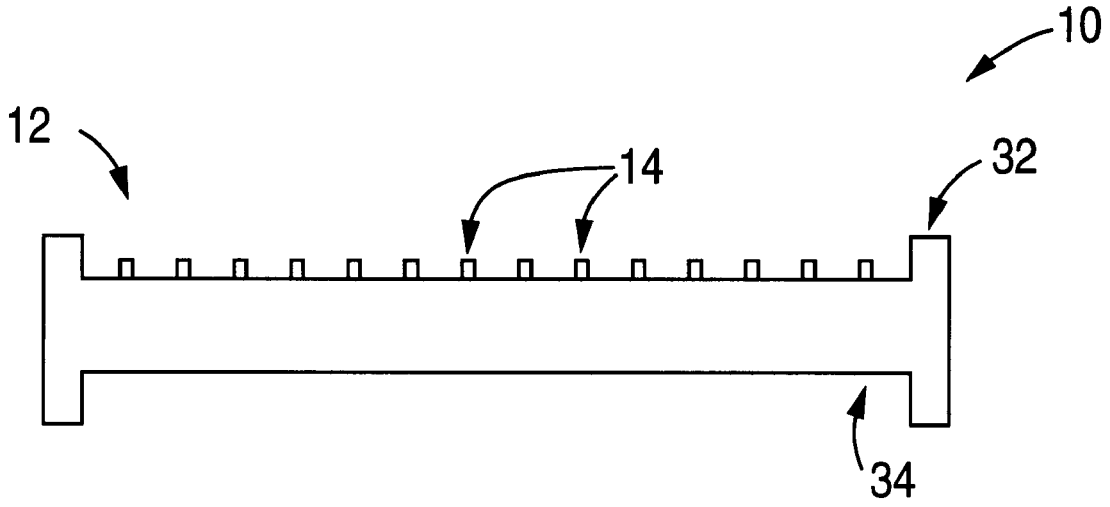
FIG. 3 is a view of another embodiment of a child's high tray according to the present invention.
Figure 4:
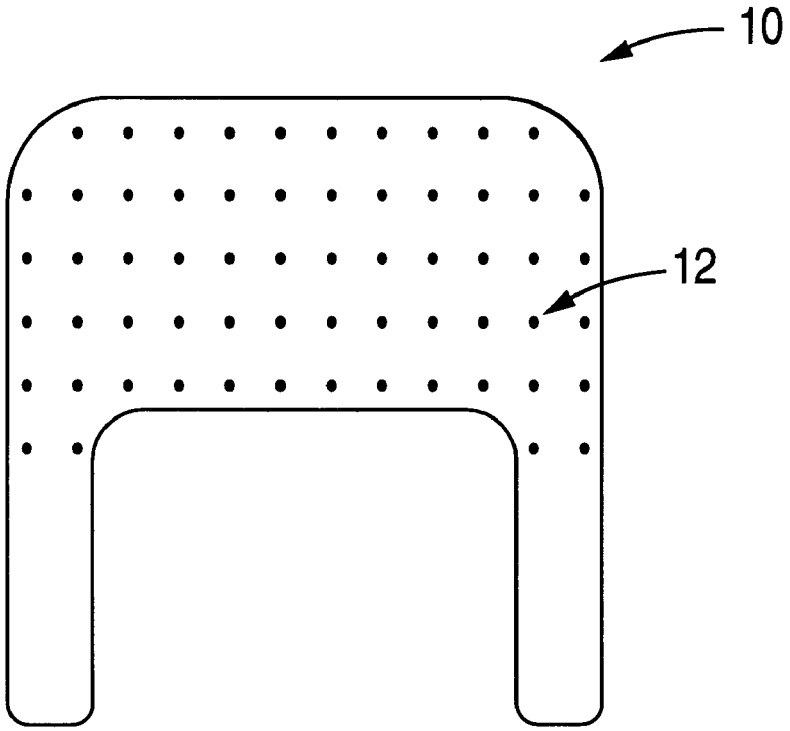
FIG. 4 is a plan view of a one piece child's high chair tray according to the present invention.

FIGS. 3 and 4 illustrate a one piece tray 10 featuring an upper surface 12 with regularly spaced projections 14 and, optionally, rim 32. The lower surface 34 of tray 10 may be smooth to accommodate utensils or toys that do not interlock with surface 12. According to this embodiment, tray 10 may be manufactured as a single piece of molded plastic, the size of which would fit commercially available high chairs. In this embodiment, the tray is reversible, i.e., can be used with smooth lower surface 34 up, if preferred. On the other hand, it should be noted that the spacing of projections on upper surface 12 can be small enough that conventionally used plates, bowls, cups and the like, would be stable when sitting over projections 14. In any case, it is also possible to include projections 14 only on selected portions of upper surface 12. For example, projections might be placed only when a plate, cup and utensil would be placed on the surface.

In this embodiment, the projections could be differently shaped on different areas of the surface so that, for example, the bowl would only fit where a bowl should be placed, a cup where a cup should be placed, etc.

The use of differently shaped matching projections for different objects would create a matching game for the child.

While the present invention is disclosed by reference to the preferred embodiments and examples detailed above, it is to be understood that these examples are intended in an illustrative rather than limiting sense, as it is contemplated that many modifications within the scope and spirit of the invention will readily occur to those skilled in the art and the appended claims are intended to cover such variations.

I claim:

1. A tray for use with a child's high chair, comprising a top surface having regularly-spaced projections thereon protruding at an angle substantially orthogonal to the top surface, each projection on the top surface being separate from the other projections on the top surface and adapted to interlock with corresponding regularly-spaced projections on a complementarily adapted surface on an eating utensil, wherein the projections on the top surface interlock with the complementarily adapted surface on the eating utensil when the projections on the top surface are between the projections on the eating utensil and the projections on the eating utensil are between the projections on the top surface.

2. A tray according to claim 1 wherein said tray includes perforations across said tray surface, the distance between said perforations being small enough to permit modification of the size of said tray.

3. A child's eating apparatus, comprising:

a tray with a top surface having regularly-spaced projections thereon protruding at an angle substantially orthogonal to the top surface, each projection on the top surface being separate from the other projections on the top surface, and at least one eating utensil having regularly-spaced projections on a complementarily adapted surface for interlocking with the regularly-spaced projections on the tray, wherein the projections on the top surface interlock with the complementarily adapted surface on the eating utensil when the projections on the top surface are between the projections on the eating utensil and the projections on the eating utensil are between the projections on the top surface.

4. An eating apparatus according to claim 3, wherein said tray includes perforations across said tray surface, the distance between said perforations being small enough to permit modification of the size of said tray.

* * * * *